US006118386A

United States Patent [19]

Yousif

[11] Patent Number: 6,118,386

[45] Date of Patent: Sep. 12, 2000

[54] QUAKER—ALERTER W/RADIO-ADVISORY AND MODULAR OPTIONS

[76] Inventor: Marvin J Yousif, 3414 Via Palma, La Mesa, Calif. 91941

[21] Appl. No.: 09/328,359

[22] Filed: Jun. 9, 1999

[51] Int. Cl.[7] ..... G08B 21/00

[52] U.S. Cl. ..... 340/690; 340/691.5; 340/539; 340/693.5; 340/669; 340/665; 340/286.02

[58] Field of Search ..... 340/690, 539, 340/691.5, 693.5, 669, 665, 286.02; 367/13, 14

[56] References Cited

U.S. PATENT DOCUMENTS

| | | | |
|---|---|---|---|
| Re. 36,300 | 9/1999 | Gonzalez | 367/13 |
| 5,910,763 | 6/1999 | Flanagan | 340/286.02 |

*Primary Examiner*—Benjamin C. Lee

[57] ABSTRACT

An improved safety related compact hand-portable apparatus for home or office use, EQ-Alert™ is ceiling or shelf mountable, activating upon sensing a minimum-threshold earthquake preferably of about 3.25/Rictor-scale intensity, instantly emitting a series of approximate 110-decibel level siren-alarms;—preferably along with activation of a safety-lamp to illuminate an immediate floor-area in event of community power-outage. A preferably dry-cell powered dc/electronic IC-chip timer-circuit, limits duration of the audible-alarm, triggered by sufficient movement of an internal omni-directional mercury n.o./jiggle-switch. Upon completion of the timed audible-alarm and optional voice-chip announcement, the timer-circuit sequences a conventional integral superheterodyne-AM/radio user has preset to a local Conelrad/news-station, for ongoing notification of any earthquake rescue procedures. Optional provision for plug-in circuit-modules, facilitates adding of allied safety-units, such as substantially conventional smoke-alarm, and carbonmonoxide-alarm detectors, sharing the audio-transducer and IC-microprocessor; to issue forth separate short programed voice-announcements as to the detected hazards.

18 Claims, 1 Drawing Sheet

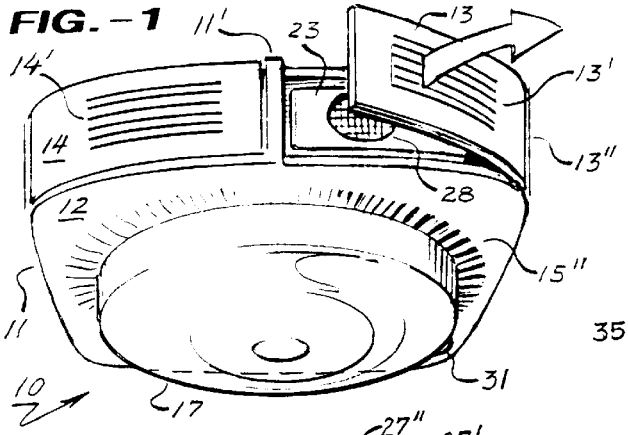
FIG.-1
11'
23
13
14'
13'
14
13"
28
12
15"
11
31
10
17
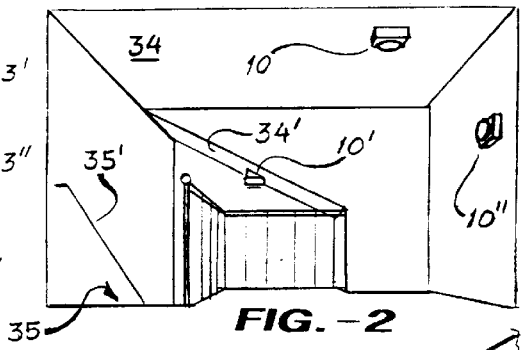
34
10
34'
10'
35'
10"
35
FIG.-2
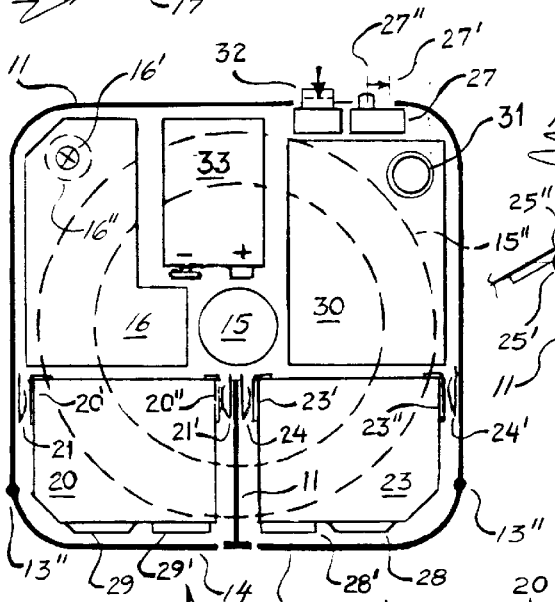
27"
27'
11
16'
32
27
31
10'
33
16"
15"
16
15
30
20'
20"
23'
21'
24
23"
24'
21
20
11
23
13"
13"
29
29'
14
28'
28
13
19
22
FIG.-3
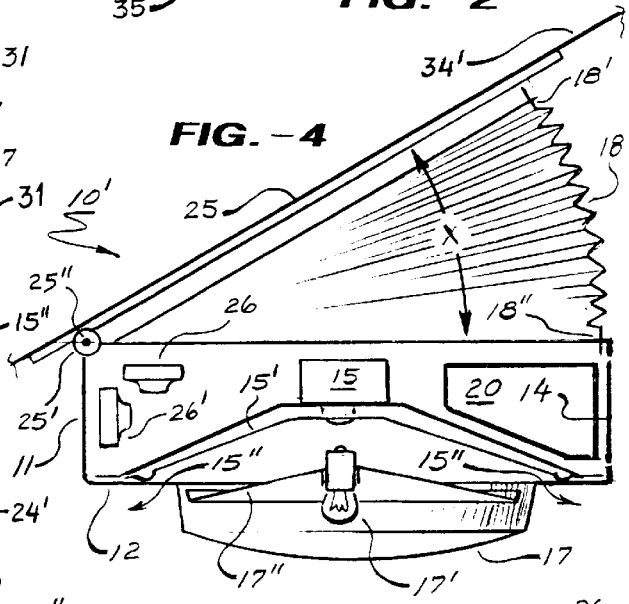
34'
18'
FIG.-4
18
25
25"
26
18"
25'
26'
15'
15
20
14
11
15"
15"
12
17"
17'
17
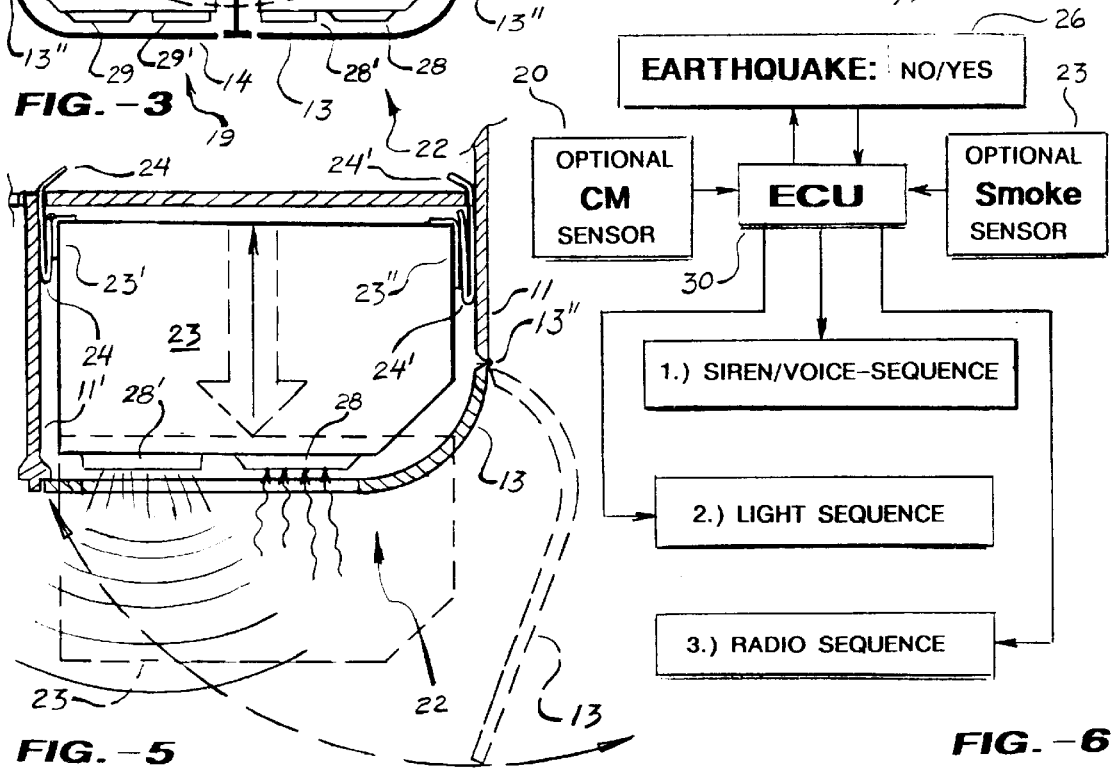
EARTHQUAKE: NO/YES
26
20
23
OPTIONAL CM SENSOR
ECU
OPTIONAL Smoke SENSOR
30
1.) SIREN/VOICE-SEQUENCE
2.) LIGHT SEQUENCE
3.) RADIO SEQUENCE
24
24'
22
23'
23"
11
13"
23
24
24'
11'
28'
28
13
23
22
13
FIG.-5
FIG.-6

QUAKER— ALERTER W/RADIO-ADVISORY AND MODULAR OPTIONS

BACKGROUND OF RELEVANT EARLIER INVENTIONS

This invention particularly relates to seismic (from the Greek-language word seismos, meaning—"shock" or shake) detector devices having means for sensing and instantly announcing quake occurrence on a celestial body. More specifically, the disclosure concerns earthquake detection apparatus employing a mercury-switch motion detector, including the combination of illumination and radio devices; and, additionally relating to both smoke-alarm and CM(CarbonMonoxide, also termed CO)-alarm devices. Background research discovery provides some prior patent-art regarded as germane to this disclosure, chronologically for example U.S. Pat. No. 3,909,816(filed: April 1972) shows a type of electrically operated device designed to detect an inordinately high level of CM presence in the air. The device employs an adjustable semiconductor resistance-medium detector-element which is heated to obtain control of the detection level as appropriate for the application. However, the heat involved cn pose a fire-hazard;—moreover, current demand of this type of CM-detector is beyond that considered practical for preferred drycell-battery dependent operation.

In U.S. Pat. No. 4,408,196(filed: March 1981) is shown an earthquake alarm system for a installation in the ceiling of a building, wherein is employed a starburst plurality of azimuth encircling inertial (mechanically movable weights) sensor-switches, any one of which can function directionally in displaced fashion to complete a NO(normally-open) electrical-circuit. Although the shown ring of some 20 to 26 sensor-switches is probably not a practical consideration, the further combination of a resultantly activated light, also set forth in U.S. Pat. No. 4,789,922 (filed: May 1987 for an earthquake safety-light) in cooperation with an audible-alarm and a spoken-announcement is relevant to this disclosure. However, here the notion of a spoken-announcement is provided in the form of a preprogrammed statement, such as instructions for orderly evacuation of a building for example. No real-time emergency announcement capability is contemplated.

In U.S. Pat. No. 5,063,164 (filed: June 1990) is shown a biomimetic-sensor which simulates human response to air-borne toxins, in which is discussed the problem of CM detection among devices such as catalysts, which experience a an impractically short functional-life substantially less than one year. However, while the function of the disclosure appears capable of mimicking human response to CM toxin with regard to sensitivity and affinity, by use of a chemical-reagent molecular encapsulant, the device has thus far appeared reliable little beyond a year;—which is not considered commercially to be very viable. Accordingly, in U.S. Pat. No. 5,280,273 (filed: December 1992) the same inventor (M. E. Goldstein) introduced a compact CM-detector system featuring means for convenient periodic CM-detector and battery unit replacement, as a disposable plug-in module. In this regard, a Forbes-magazine (Jan. 13, 1997, Pg.-52) article gave a rather blistering evaluation of less-costly home type CM-detectors,—said prone to register false-alarms, owing to overly sensitive detection devices. A study by the national GRI(GasResearch-Institute) indicated that 87% of the alarms triggered by CM-sensors built to UL's(Underwriters-Laboratories Inc.) 1995-standard,—were false! Even worse, in another GRI study 9 out of 24

UL-certified CM-alarms even failed to go-off when they should have! There being no way to know for sure if the CM-sensors really worked properly, as the "test-button" is actually merely a check on circuitry-continuity and of the battery! Thus, on October 1996 the GRI helped issue a stricter new standard, endorsed by the U.S.Consumer-product Safety-commission,—requiring two new key features. CM-alarms must now be insensitive to safe-levels of CM, and must include a mechanism by which the CM-sensor is actually proven to be functioning properly. The first company to meet the new standard is said to be AimSafety Corp. of Texas, selling through retail-stores such as Sears, Target, Wal-Mart. There remains consumer confusion over product-reliability, with some product sales-literature stating no periodic replacement of their CM-sensor is required. It is said that electrochemical CM-sensors register better responsiveness, sensitivity, and selectivity, on the order of 10–100 times over semiconductor type CM-detectors. Readings of 0.1–100/PPMV(parts per million by volume) being characteristic for electrochemical CM-sensors, with federal groups such as OSHA (Occupational Safety & Health Administration and the EPA (Environmental Protection Agency) now endorsing a low 9/PPMV (a reading of only 4/PPMV indicative of potential health hazard if ongoing).

In U.S. Pat. No. 5,331,310 (field: April 1992) is shown a believed practical, reliable, and less-costly CM-sensor unit of the electrochemical amperometric type operating off a 9v-drycell battery. This CM-sensor comprises a reference-electrode, plus a sensing-electrode formed by a polypropylene-plastic vial containing an electrolyte such as a low-evaporative sulfuric-acid gell, in combination with an activated-carbon air-filter containing permanganate-salt. An electronic-circuit is set forth, but is is not being presented herein as prior-art since the instant invention hereof does not intend to set forth any manner of improved CM-sensor device circuit; but only to operate in conjunction with the best available conventional practice.

In U.S. Pat. No. 5,101,195 (filed: September 1989, to Quakeawake Corp.) is shown an earthquake alarm unit employing two cylinderical mercury/tilt-switches arranged at a right-angle to one another, in which the sensitivity is said to be regulated according to the degree of inclination to which the two mercury-switches are set. The two angularly opposed mercury-switches are further rotationally mounted on a horizontal-axis enabling 360-degree adjustment, which is of dubious value. More modern jiggle-switches are considered to be more suitable.

In U.S. Pat. No. 5,146,209 (field: March 1991) is shown a rechargable-battery powered emergency-light apparatus, serving in event of main electrical line-current interruption; at which time the portable-light is unplugged from the main line-current receptacle and hand-carried as desired. The portable-lamp includes a sensor capable of detecting indoor presence of at least one of the following occurrences:—natural-gas fumes, smoke, abnormal heat, flame; including a separate CPU(central electronic-processing unit) for each said occurance. While the 3-position control-switch ("0"-off) has no provision for the light to activate automatically while the lamp is dependant upon the main line-current wall-receptacle, in switch-positions "I"&"II" an audible-alarm can activate while plugged-in. Provision is also given for sending a wireless radio-relay from the portable apparatus, as to detection of such an emergency occurrence, to an announcement-alarm station situated elsewhere in the building for example.

In U.S. Pat. No. 4,893,224 is merely shown an power-failure emergency batery-powered light-fixture for a stairwell; while in U.S. Pat. No. 5,184,889 (filed: February 1992) is shown a battery-powered earthquake detecting wall-lamp, employing a conventional commercially available tilt-sensitive type mercury-switch as it's sensory device. Included in critical combination with the mercury-switch is a novel plunger-switch device which becomes biased when the wall-hung lamp tips askew, and activates the N.O. (normally-open) mercury-switch.

In U.S. Pat. No. 5,396,223 (filed: December 1990 via Japan) is shown special earthquake sensitive mercury-switch device having a tiny cup-like metal casing, including a central recess portion thereto, serving to pool the liquid-metal. The casing serves tantamount ot one electrical conductor or electrode, plus at least two (preferably three or more) of the second conductor electrodes are disposed circumferentially around a droplet of Mercury liquid located via gravity into the recess. The Mercury is thus able to sensitively respond, making electrical continuity between the casing and the second conductor, in reaction to vibration or resonance thereto sufficient as to cause the N.O.-switch to close.

In U.S. Pat. No. 5,546,076 (filed: June 1995) is shown an earth-tremor responsive light in which is featured a special switch employing a metal-ball within an annular cavity having a bottom-surface which slopes only slightly to the center of the cavity. A plunger is delicately rested atop the ball, whereupon any lateral shift of the ball (owing to inertial effect of the ball's mass during earth movement) enables the spring-loaded plunger to instantly bias down completing a Norm.Open/electrical-circuit. Upon closing of the circuit, a light-bulb is lit from power of two drycell-batteries. The device is referenced here, in as much as it appears possibly tantamount in effectiveness to the immediately preceding referenced mercury-switch device, and therefore the ball & plunger methodology set forth is considered a good example of an alternate class type seismic sensor-device.

The preceding patent-art demonstrates there continues to be a need for new and improved earthquake indicating lighting apparatus addressing both the problems of ease of use, along with effectiveness of construction; and in this respect, the present invention substantially fulfills this apparent need. Therefore, in full consideration of the preceding patent review, there is determined a need for an improved form of device to which these patents have been largely addressed. Accordingly, the instant inventor hereof believes their newly improved CM-alerting device, commercially referred to as the EQ-ALERT™, currently being developed for production under auspices of M&J-Mfg./Mkt.Co., exhibits certain advantages as shall be revealed in the subsequent portion of this instant disclosure.

SUMMARY OF THE INVENTION

A.) In view of the foregoing discussion about the earlier invention art, it is therefore important to make it pellucid to others interested in the art that the object of this invention is to provide a multi-functional omni-directional (in all horizontal azimuth directions) seismic disturbance detector, serving to: a.) sequentially identify an earthquake event; b.) then audibly alert a building occupant and visually orientate them (in case of smoke and darkness) via a light; c.) then vocally advise them as to any actual local emergency procedures.

The apparatus involved being essentially a supporting structure serving as a mounting base, housing an ECU (electronic control unit) including a micro-processor factory programmed to orderly sequence several priority functions upon activation of a passive (normally-off, but in a standby modality to close a circuit to a powering source of electrical-current) detector-circuit preferably in the form of a Mercury-switch such as defined under previously reviewed U.S. Pat. No. 5,396,223 (by Matsushita Electric Industrial Corp.).

The housing to secure therein a first-priority high-decible commercially-available conventional audio-transducer alarm (electric horn, siren, buzzer, etc.), arranged to propagate outwardly without appreciable loss of audible amplitude. Also included within housing confines is a second-priority function of a conventional commercially-available. electric-lamp, capable of illuminating the immediate area.

Plus, a third-priority function and an associated user operable 'test-button' be arranged so as to combine an electrically sequenced AM/radio-receiver providing 'user pre-selected' 24-hour/emergency Conelrad(or equivalent, such as EBS/emergency broadcasting system and EAS/emergency alert system) frequency tuning-control (generally a variable-condenser, adjustable by user's fingers or via screwdriver), so as to automatically thereby vocally announce possible vital real-time (actual,—not pre-programmed) rescue progress information to a possibly trapped listener.

The source of electrical-power being either via integral replacable drycell-battery (two to four recomended, preferably of 9v/dc-lithium type); or, via conventional commercially available step-down/dc-transformer connection sourced outside the housing to the building's ac(alternating-current)line-current.

B.) Another object of this invention disclosure is to set forth the foregoing described apparatus, wherein the housing further optionally includes a female electrical plug-in cavity like receptacle. The female-receptacle having at least two discrete receptor/electrical-conductors, which conductively coinside respectively with discrete electrical-conductor terminals provided upon an accessory electronic-module containing a substantially conventional commercially-available carbonmonoxide-detector.

Accordingly, It is preferred this module and an associated user operable 'test-button' be arranged in electrical connection with an audio-transducer device so as to produce a siren type alarm action. Plus it is preferred, that the audio-transducer be arranged in electrical connection with mentioned ECU/micro-processor, so as to propagate a factory created voice-announcement preferably stating (for example): "Attention,—this is a life-threatening carbon-monoxide danger alert"—then preferably a few siren sounds;—whereupon the sequence will repeat again, and again, until as may be defeated by the user if only a periodic-test of the system.

C.) Another object of this invention disclosure is to set forth the foregoing described apparatus, wherein the housing further optionally includes a female electrical plug-in cavity like receptacle. This female-receptacle having at least two discrete receptor/electrical-conductors, which conductively coinside respectively with discrete electrical-conductor terminals provided upon as accessory electronic-module containing a substantially conventional commercially-available smoke-detector.

Accordingly, It is preferred this module and an associated user operable 'test-button' be arranged in electrical connection with an audio-transducer device so as to produce a siren type alarm action. Plus it is preferred, that the audio-transducer be arranged in electrical connection with mentioned ECU/micro-processor, so as to propagate a factory created voice-announcement preferably stating (for example): "Attention,—this is a life-threatening smoke and fire alert", then preferably a few siren sounds;—whereupon the sequence will repeat again, and again, until as may be defeated by the user if only a periodic-test of the system.

D.) Another object of this invention disclosure is to set forth the foregoing described apparatus, wherein the housing and built-in mercury-switch can be horizontally leveled by optional employment of a combination of mounting-base portion and a co-hinged main-housing portion. The axis of a laterally offset hinge member is arranged proximally tangent to the main-housing portion, and parallel with the mounting surface such as a ceiling; thereby enabling the main-housing to be manually pivoted to a level attitude, while the mounting-base portion is at an angle, such as when secured to the inclined ceiling of a stairwell for example (which generally may be as much as 45-degrees). Additionally, it is preferred that a substantially cosmetic accordion or bellows like annular shroud member be included, whereby one end of the accordion be secured to the mounting-base portion, while the opposite end be secured to the main-housing portion; thereby serving to lend a more contiguous and integrated appearance to the two co-hinged portions, when the alerting apparatus is biased into the pivoted apart modality of usage already mentioned.

DESCRIPTION OF THE PREFERRED EMBODIMENT DRAWINGS

The foregoing and still other objects of this invention will become fully apparent, along with various advantages and features of novelty residing in the present embodiments, from study of the following description of the variant generic species embodiments and study of the ensuing description of these embodiments. Wherein indicia of reference are shown to match related matter stated in the text, as well as the claims section annexed hereto; and accordingly, a better understanding of the invention and the variant uses is intended, by reference to the drawings, which are considered as primarily exemplary and not to be therefore construed as restrictive in nature; wherein:

FIG. 1, is a pictorial perspective-view, favoring the frontal-side and broad front-surface portion of the apparatus housing;

FIG. 2, is a pictorial perspective-view showing a room interior of a building, depicting ways the invention apparatus may be installed;

FIG. 3, is a diagrammatic top/plan-view of the invention housing exemplifying packaging relationships between supporting component members, including optional sensor-module units;

FIG. 4, is a diagrammatic side/elevation-view depicting how the invention apparatus appears installed upon a flat-horizontal ceiling, or optionally upon an inclined ceiling, and alternately upon a wall;

FIG. 5, is an enlarged diagrammatic top/plan-view thereof, exemplifying how the optional sensor-module's plug-in female-receptacle may be configured;

FIG. 6, is an exemplified rudimentary logic-circuit, showing the fundamental arrangement of priority levels involved in the invention's electrical-circuit.

ITEMIZED NOMENCLATURE REFERENCES

10/10'/10"—the overall housing assembly (shown horizontal/inclined/vertical)

11,11'/11"—housing sidewall, internal-walls

12—housing front-surface

13,13'—optional access-door, air-flow slots

14,14'—optional access-door, air-flow slots

15,15',15"—audio-transducer driver, speaker-cone, sound outleting area

16,16'/16"—radio-circuit section, radio tuning-control (external/internal)

17,17'17"—safety area-light lens, light-bulb, reflector

18,18'/18"—accordion-wedge member, opposed securing-ends

19—first-module female-receptacle area

20,20'/20"—first-module, electrical-contacts thereto (X/Z)

21/21'—first-module receptacle-area fixed-terminals (X/Z)

22—second-module female-receptacle area

23,23'/23"—second module, electrical-contacts thereto (X/Y)

24/24'—second-module receptacle-area fixed-terminals (X/Y)

25,25',25"—mounting-base, hinge member, hinge-axis

26/26'—motion-sensor (horizontal/vertical)

27,27'/27"—optional selector-switch (horizontal/vertical)

28,28'—exemplified CM detection-aperture, optional CM audio-siren

29,29'—exemplified smoke detection-aperture, optional smoke audio-siren

30—ECU(electronic control unit)

31—ECU circuit-test momentary-on switch

32—radio frequency-test momentary-type switch

33—battery

34/34'—ceiling (level/inclined)

35,35'—stairwell, stairwell-ceiling

DETAILED DESCRIPTION OF THE PREFERRED EMBODIMENTS

Initial reference is given by way of FIG. 1, wherein is exhibited the overall earthquake alerter assembly 10, having a preferably molded-plastic housing comprised of sidewall 11, front-surface 12, optional internal-wall 11'; plus, optional access-doors 13/14 . Since the primary function of this invention is to essentially provide an earthquake alerting means, there are only certain components considered necessary herein toward serving this purpose. For example, the operational logic-circuit presentation of FIG. 6, shows the notion of my design philosophy hereto, consisting of requisite horizontal-mount motion-sensor 26 (or optional vertical-mount detector 26' FIG. 4) detecting an earthquake event (see-"yes","no" being a normally-open circuit condition), the closing of a circuit thereby signaling the ECU(electronic-control unit) 30 of FIGS. 3 & 6 to activate the (sequence-1. of FIG. 6) audible horn/siren and (preferably alternating every few seconds) mircoprocessor automated voice-chip (factory programmed announcement as to earthquake occurance). Next, the ECU's 30 conventional microprocessor timer circuit activates (sequence-2. of FIG. 6) an area light 17 (generally) to be activated in likelihood of the building's line-current power outage.

Thus far, we have depicted the fundamental apparatus of this disclosure as only being basically capable of awakening a possible sleeper(s) via sequence-1 in FIG. 6, then having lit an area of possible exit via sequence-2 of FIG. 6; at which point preferably a third considered vital radio function (see-3. in FIG. 6) ensues providing a real-time source of emergency information, emanating from an existing local broadcasting-station of the federally authorized EAS type (usually having a powerful 50,000-watt transmitter). Reference to FIGS. 1 & 3 also shows a momentary test-button 31, which when pressed into closed-circuit position enables the user to initially tune to their local EAS/broadcast-station via an internal tuning-control 16" (FIG. 3), or via a phillips-screwdriver accessed hole in the outwardly exposed housing front-surface 12 . This arrangement of switch 31 thus prevents radio-circuit 16 (FIG. 3) from being played as a normal radio (hence, running down battery 33), while enabling periodic quick and easy testing of the EAS/broadcasting circuit tuning accuracy and battery 33 (FIG. 3) power.

Note also in FIGS. 2, 3, 4 that it is preferred (albeit not required) the requisite horizontal motion-sensor switch 26 be coupled with the alternate right-angle like motion-sensor switch 26'. The exemplified room environment depicted in FIG. 2 shows how the alerter unit can be installed in a horizontal-attitude 10 on ceiling 32, by selecting switch-position 27' (FIG. 3);13 or alternately, may be installed on an adjoining wall at a vertical-attitude 10" by selecting switch-position 27" (hence, motion-sensor 26' is chosen, as it is now instead in a horizontal attitude). Still another installation adaptation is depicted in FIG. 2, wherein the earthquake alerter apparatus is shown mounted upon an inclined ceiling at 10'; which is further detailed in FIG. 4 (showing the apparatus rotated 180-degrees in horizontal azimuth from it's position in FIG. 2), wherein is revealed how the housing sidewall 11 can include a laterally arranged hinge 25' having hinge-axis 25", enabling plate like mounting-base 25 to be conveniently biased to an attitude (ref.arrow-X) which relevels necessarily horizontal motion-sensor switch 26 from an otherwise unworkable pitch-attitude posed by stairwell-ceiling 35'. So as to make the resulting opening-gap (ref.arrow-X) between mounting-base 25 and housing sidewall 11 appear attractive, a U-shaped (3-sided) accordion folding member 18 is preferably included; the opposed ends 18'/18" of which secure to adjoining sidewalls 11.

There remain subtle, however vital other differences which are to become herein more evident and understood as important improvements. For example, FIG. 4 also shows how I preferably locate the light-subassembly (comprising reflector 17", light-bulb 17', transparent-lens 17) coaxially to a conventional audio-transducer (radio-speaker) comprised of PM-driver 15, and dynamic speaker-cone 15', The advantage of this novel coaxial arrangement being that both a maximum sized audio-transducer (for best distortion-free audibility) and a big light-fixture (for good light spread) can be accommodated, within a surface-area which would require the speaker-cone and light-reflector be much smaller if otherwise placed side-to-side. The ample annular sweep-area of the sound outletting port 15" (comprised of plural radiating slots), facilitates both good outward sound propagation and a solid mounting surface for the light-fixture.

Further reference to FIGS. 1, 3, 4, 5 reveals the provision of optional(may be purchased at extra-cost on the retail level, or may be factory-installed) modular plug-in devices in the form of either a CM(carbonmonoxide)-sensor unit 20, or a modular smoke-sensor unit 23. If the housing enshrouds these modular units, air-flow apertures such as are depicted in FIG. 1 as plural tiered-slots 13'/14' formed here respectively into optional ornamental-doors or access-covers 13/14. Howsoever the determined arrangement of plug-in receptacle for these sensor-modules, good air-flow circulation is needed to assure the detection devices 28/29 built-in to these modules are able to function effectively. The plan-views of FIGS. 3, 5 merely serve to show the presently preferred physical arrangement of modular sensors 20 and 23, relative to their respective female receptacles 19 and 22. In the right-hand receptacle area 22 of FIG. 3, 2½X—enlarged in detail FIG. 5, is shown how at least two or more preferably slide-by type electrical fixed-terminals 24/24' can be arranged to impinge directly upon respective mating electrical contacts 23'/23" thereto; thereby interfacing electrically with the ECU 30. The phantom outline of exemplified second-module/smoke-sensor 23 demonstrates how the module is preferably slid in/out (see adjoining ref.arrows) relative to it's female-receptacle cavity 22.

In operation, with both the CM and optional smoke sensor modules in place (FIG. 3) for example, and upon detection of a CM danger-level at point 28 (but no smoke detected), the optional siren (approximately 110 db amplitude) 28' will activate, but momentarily deactivate to enable clearly heard ECU/voice-chip produced announcement via large loud-speaker 15 that: "this is an an emergency, a dangerous life-threatening level of carbonmonoxide has been detected"—(siren)"beep" "beep" "beep"—(speaker)"this is an emergency . . . (etc.). This action continues until user defeats the action by pressing the ECU/test-button 31 (or until battery depletion).

The same manner of operation may be likewise applicable to the reaction of the smoke-module 20 detector 29 (FIG. 3) to presence of smoke, that is the optional siren (approximately 110 db amplitude) 28' will activate, and momentarily deactivating only to enable clearly heard ECU/voice-chip produced announcement via large loud-speaker 15 that: "this is an an emergency, a dangerous life-threatening level of smoke has been detected"—(siren) "beep" "beep" "beep"—(speaker)"this is an emergency . . . (etc.); until user defeats the action by pressing ECU/test-button 31 (or until battery depletion).

However, in circumstance of a coinciding Earthquake detection event, the radio announcement would eventually (generally after about 10-minutes) override the otherwise alternating voice-chip announcements just described. This entire series of audio functions being controlled by the factory programming of the ECU 30, whereby if the optional modules (or otherwise built-in like detection and audio functions thereof) are not in place, then the basic earthquake alerter apparatus functions as earlier described herein.

Thus, it is readily understood how the preferred and generic-variant embodiments of this invention contemplate performing functions in a novel way not heretofore available nor realized. It is implicit that the utility of the foregoing adaptations of this invention are not necessarily dependent upon any prevailing invention patent; and, while the present invention has been well described hereinbefore by way of certain illustrated embodiments, it is to be expected that various changes, alterations, rearrangements, and obvious modifications may be resorted to by those skilled in the art to which it relates, without substantially departing from the implied spirit and scope of the instant invention. Therefore, the invention has been disclosed herein by way of example, and not as imposed limitation, while the appended claims set out the scope of the invention sought, and are to be construed as broadly as the terminology therein employed permits, reckoning that the invention verily comprehends every use of which it is susceptible. Accordingly, the embodiments of the invention in which an exclusive property or proprietary privilege is claimed, are defined as follows.

What is claimed of proprietary inventive origin is:

1. An omni-directional motion disturbance detection apparatus serving to identify an earthquake event, then vocally advising in real-time as to any actual local emergency procedures; comprising:

a supportive-structure housing an ECU (Electronic Control Unit) means capable of sequencing priority functions upon activation of a detector-circuit portion thereof;

a passive detector-circuit employing a full-azimuth motion-sensor device means having at least two electrical conductors arranged in a stand-by modality of detection operation to initiate all priority functions;

a first priority function electrically sequenced radio-receiver having user pre-selected emergency frequency tuning means, vocally announcing vital real-time information;

a source of electrical energy capable of powering all electrical functions but nulled until activated via said detector-circuit.

2. The earthquake alerting device according to claim 1, wherein said motion-sensor device means is a mercury-switch.

3. The earthquake motion-sensor device means according to claim 2, wherein said mercury-switch is a normally-open type.

4. The earthquake alerting apparatus according to claim 1, wherein said motion-sensor means comprises two motion-sensor devices, a first motion-sensor device arranged on a plane parallel to said base surface, and a second motion-sensor device arranged on a plane at a right-angle to said base-surface; thereby enabling an electric switch to be biased to select either horizontal ceiling-mounting for said first device, or biased to an alternative switch position selecting said second motion-sensor for vertical-wall mounting installation.

5. The earthquake motion-sensor device according to claim 2, wherein said mercury-switch can be horizontally leveled via laterally offset hinging means, enabling critical leveling of the said main-housing portion relative to co-hinged mounting-base portion; thereby for example, enabling said housing to be mounted upon an inclined stairwell ceiling.

6. The earthquake alerting apparatus according to claim 1, wherein said motion-sensor device means is a ball and plunger type construction, whereby inertia reaction of the ball enables a plunger to bias into an alternate closed-circuit position.

7. The earthquake alerting apparatus according to claim 1, wherein said motion-sensor means includes two discrete mercury-switches arranged at a right-angle to each other; including a selector-switch enabling the user to choose one of said motion-sensors for horizontal mounting installation, the other said motion-sensor for vertical mounting installation.

8. The earthquake alerting apparatus according to claim 1, wherein said emergency frequency tuning means is user selected from an existing government regulated emergency clear-channel advisory.

9. The earthquake alerting apparatus according to claim 1, wherein said electrical-circuit power means is via a d.c.-battery contained within said housing confines.

10. The earthquake alerting apparatus according to claim 1, wherein said electrical-circuit power means is via an ac/line-current sourced outside said housing, and reduced into lower dc-current for normal circuitry operation.

11. The earthquake alerting apparatus according to claim 1, wherein said supporting-structure and associated said electric-circuit means includes a female electrical plug-in, accommodating optional interfacing of an accessory electronic-module facilitating expansion of priority functions to include a carbon-monoxide detector device; said carbon monoxide-detector's electrical-circuit having an audio-alarm audio-transducer.

12. The earthquake alerting apparatus according to claim 1, wherein said supporting-structure and associated said electric-circuit means includes a female electrical plug-in, accommodating optional interfacing of an accessory electronic-module facilitating expansion of priority functions to include a smoke-detector device; said smoke-detector's electrical-circuit having an audio-alarm audio-transducer.

13. The earthquake alerting apparatus according to claim 1, wherein said radio-receiver is circuited with said ECU to include a momentary-on type activating switch, enabling said radio receiver to be briefly activated to check frequency tuning.

14. The earthquake alerting apparatus according to claim 1, further comprising a carbon-monoxide detector module having a biomimetic-sensor device of the type capable of mimicking human-response to the CM-toxin via use of a molecular-encapsulant holding at least one component of the chemical sensory reagent.

15. The earthquake alerting apparatus according to claim 1, wherein said motion-sensor is a mercury-switch wherein the casing serves tantamount to one said conductor or electrode, and at least two second said conductor electrodes are disposed circumferentially around a droplet of Mercury liquid located via gravity into a recess of said casing; whereby said Mercury is able to sensitively respond to make electrical continuity between said casing and a said second conductor either via vibration or resonance thereto sufficient as to cause said continuity switch to close.

16. An omni-directional earthquake alerting method serving to notify the user of an earthquake event by vocally advising in real-time as to any actual local emergency procedures; said method comprising:

a supporting-structure housing an ECU means capable of sequencing priority functions upon activation of a detector-circuit portion thereof;

a passive detector-circuit employing a full-azimuth motion-sensor device means having at least two electrical conductors arranged in a stand-by modality of detection operation to initiate all priority functions;

a first priority function electrically sequenced radio-receiver having user pre-selected emergency frequency tuning means, vocally announcing vital real-time information;

a source of electrical energy capable of powering all electrical functions but nulled until activated via said detector-circuit.

17. The earthquake alerting method according to claim 16, wherein said motion-sensor device means is a normally-open type mercury-switch.

18. An omni-directional earthquake alerting apparatus serving to notify the user of an earthquake event by vocally advising in real-time as to any actual local emergency procedures; said apparatus comprising:

a supporting-structure housing an ECU means capable of sequencing priority functions upon activation of a detector-circuit portion thereof;

a passive detector-circuit employing a normally-open type full-azimuth motion-sensor mercury-switch device having at least two electrical conductors arranged in a standby modality of detection operation to initiate all priority functions;

a first priority function electrically sequenced radio-receiver having user pre-selected emergency frequency tuning means, vocally announcing vital real-time information;

a source of electrical energy capable of powering all electrical functions but nulled until activated via said detector-circuit.

* * * * *